United States Patent [19]

Schupphaus

[11] Patent Number: 4,465,320

[45] **Date of Patent: * Aug. 14, 1984**

[54] CUTTER DRUM ASSEMBLY FOR LONGWALL MINING MACHINES

[75] Inventor: Herbert Schupphaus, Bochum, Fed. Rep. of Germany

[73] Assignee: Gebr. Eickhoff Maschinenfabrik und Eisengiesserei m.b.H., Bochum, Fed. Rep. of Germany

[ * ] Notice: The portion of the term of this patent subsequent to Jul. 19, 2000 has been disclaimed.

[21] Appl. No.: 288,037

[22] Filed: Jul. 29, 1981

[30] Foreign Application Priority Data

Aug. 27, 1980 [DE] Fed. Rep. of Germany ..... 3032204

[51] Int. Cl.[3] ..... E21C 25/60

[52] U.S. Cl. ..... 299/81; 299/87

[58] Field of Search ..... 299/81, 90, 17, 45, 299/79, 87, 89

[56] References Cited

U.S. PATENT DOCUMENTS

| | | | |
|---|---|---|---|
| 3,563,324 | 2/1971 | Lauber | 299/81 |
| 4,049,318 | 9/1977 | Fruin | 299/17 |
| 4,154,482 | 5/1979 | Farman | 299/81 |
| 4,189,188 | 2/1980 | Schupphaus et al. | 299/53 |
| 4,219,239 | 8/1980 | Weikert et al. | 299/81 |
| 4,249,779 | 2/1981 | Best et al. | 299/81 |
| 4,251,110 | 2/1981 | Beckmann et al. | 299/17 |
| 4,314,730 | 2/1982 | Plumpton et al. | 299/17 |
| 4,351,567 | 9/1982 | Gillingham | 299/81 |

FOREIGN PATENT DOCUMENTS

| | | | |
|---|---|---|---|
| 2432533 | 1/1975 | Fed. Rep. of Germany | 299/81 |
| 2631585 | 1/1978 | Fed. Rep. of Germany | 299/81 |

*Primary Examiner*—Stephen J. Novosad
*Assistant Examiner*—William P. Neuder
*Attorney, Agent, or Firm*—Thomas H. Murray; Clifford A. Poff

[57] ABSTRACT

A cutter drum for longwall mining machines and the like of the type comprising a rotatable member having cutting bits disposed on its outer periphery and arranged to rotate about an axis extending parallel to a mine floor, the drum being movable along a longitudinal face to produce a cut extending back into the face as the drum rotates and advances. Nozzles are carried on the end of the drum at the back of the cut for spraying high-pressure liquid into the material being mined to loosen and dislodge the same. This has the advantage of eliminating cutter picks at the back of the cut and materially reduces the generation of fines and dust in this area.

4 Claims, 4 Drawing Figures

Fig. 3
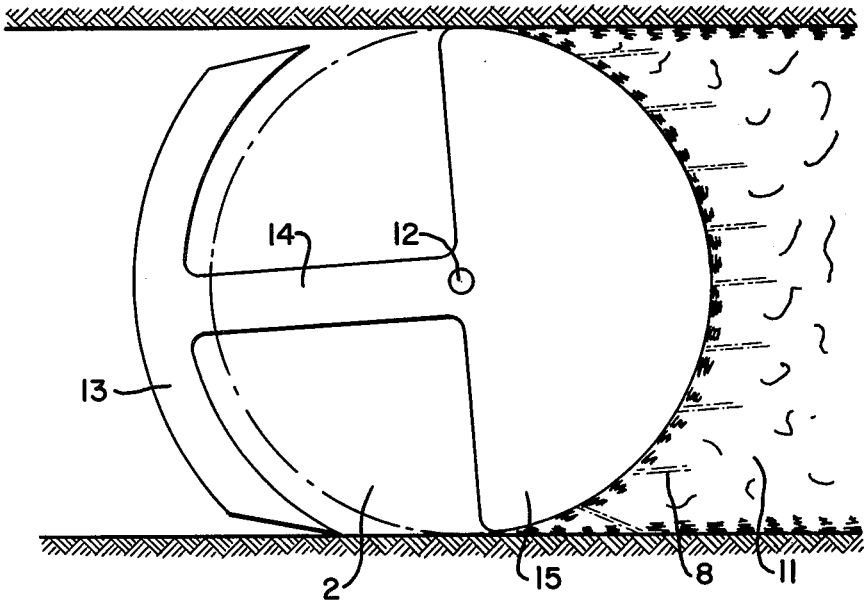
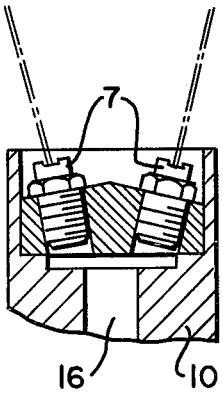
Fig. 4

CUTTER DRUM ASSEMBLY FOR LONGWALL MINING MACHINES

BACKGROUND OF THE INVENTION

The present invention relates to a longwall mining machine of the type having a pivot arm which supports a cutter drum for rotation about an axis for working a mine face. In a mining machine of this type, the rotating cutter drum, which carries cutting bits on its outer periphery, is provided with spirals which assist in loading the mined material onto a face conveyor. In the past, such cutter drums have been provided with nozzles on the periphery of their spiral conveying flights for directing liquid onto the face area being mined to reduce the generation of dust. A typical drum assembly of this type is shown, for example, in copending application Ser. No. 240,506, filed Mar. 4, 1981 and assigned to the Assignee of the present application.

It has been found that as a longwall cutter drum advances along a mine face, the hardness of the material being mined is greater at the back of the cut than at the forward edge of the cut. The difference in hardness is a result of the high rock pressure which loads the back area of the cut to a greater degree than the forward edge. That is, the overhead rock pressure loosens the material being mined adjacent the forward edge of the cut so that the forward layers of the mineral being mined tend to break up. This condition does not exist at the back of the cut, with the result that the material is much harder in this region. Consequently, the cutting resistance presented to the cutting bits is much less at the edge of the face than at the back of the cut, for in the latter zone the cutting bits impinge on very hard mineral layers and are stressed severely. To facilitate smoother operation of the cutter drum and to reduce the stressing of the cutting bits working at the back of the cut, the number of bits carried by the drum at the end adjacent the back of the cut has been increased in prior art longwall machines. This, however, results in an intense evolution of dust which impairs the operation of the mining machine and makes dust control measures essential for its operation.

SUMMARY OF THE INVENTION

In accordance with the present invention, the problems associated with the evolution of high amounts of dust at the back of the cut produced by a longwall cutter drum are obviated by replacing cutter bits at one end of the drum with nozzles which eject high-pressure streams of liquid to loosen and dislodge material being mined in that area. Through the agency of the high-pressure liquid streams which they discharge, the nozzles dislodge the very hard part of the mineral seam presented to them without the evolution of dust and excessive fines. At the same time, by virtue of the fact that they remove mineral matter, the nozzles insure that the cutter drum has the necessary clearance in that region. In the case where the nozzles extend around the entire periphery of the drum, valve means is provided to insure that only those nozzles facing the material being mined will deliver high-pressure liquid, while those on the opposite side of the drum will not.

In the case of a cutter drum which carries a rotatable end ring on its face which is disposed at the back of the cut, only the end ring is provided with nozzles for spraying a high-pressure liquid stream. In such a cutter drum, the high-pressure nozzles and the radial ducts connecting the same to a central liquid supply line extending through the cutter drum are disposed on a component which is separate and apart from the drum itself. This facilitates an easier arrangement of nozzles since the end ring has no spiral flights.

Alternatively, the axle which supports the cutter drum can carry at its extended end a non-rotatable circular nozzle plate which is disposed beyond the end face of the cutter drum proper. In this construction, it becomes unnecessary to control the flow of liquid to the nozzles as the drum rotates since the nozzle holder in this case is non-rotatably mounted on the shearer drum axle. Preferably, a non-rotatable nozzle of this type has two groups of nozzles distributed over its periphery, one group being adapted to deliver high-pressure liquid in one direction of machine travel and the other group being adapted to deliver high-pressure liquid in the other direction of machine travel.

In the case of a cutter drum provided with a cowl supported on an arm at the extreme end of the drum axis, a generally semicircular plate can be connected to the arm opposite the cowl. Since the cowl is always pivoted into a position where it follows the travel of the drum, the periphery of the semicircular plate, provided with the aforesaid high-pressure nozzles, will always face the material being mined.

Conveniently, the nozzles extend radially or tangentially relative to the periphery of the shearer drum and have alternate and opposite inclinations with respect to the axis of the drum.

The above and other objects and features of the invention will become apparent from the following detailed description taken in connection with the accompanying drawings which form a part of this specification, and in which:

FIG. 3 is a side view of a cutter drum for a longwall mining machine employing a cowl assembly and incorporating another embodiment of the invention; and FIG. 4 is a cross-sectional view showing the inclination of the nozzles which can be used in the embodiments of the invention.

The cutter drum of the invention is adapted for use with a longwall mining machine of the type shown, for example, in U.S. Pat. Nos. 4,189,188 and 4,236,758. A mining machine of this type comprises a machine body which travels along a face conveyor, the machine body having two cutter heads stationed at its opposite ends, each cutter head being provided with a pivot arm equipped at its end with a rotatable cutter drum. The drum carries on its periphery cutter bits which loosen and dislodge material being mined as the drum rotates, the loosened mined material being conveyed by spiral flights on the cutter drum onto the face conveyor.

Figure 1:
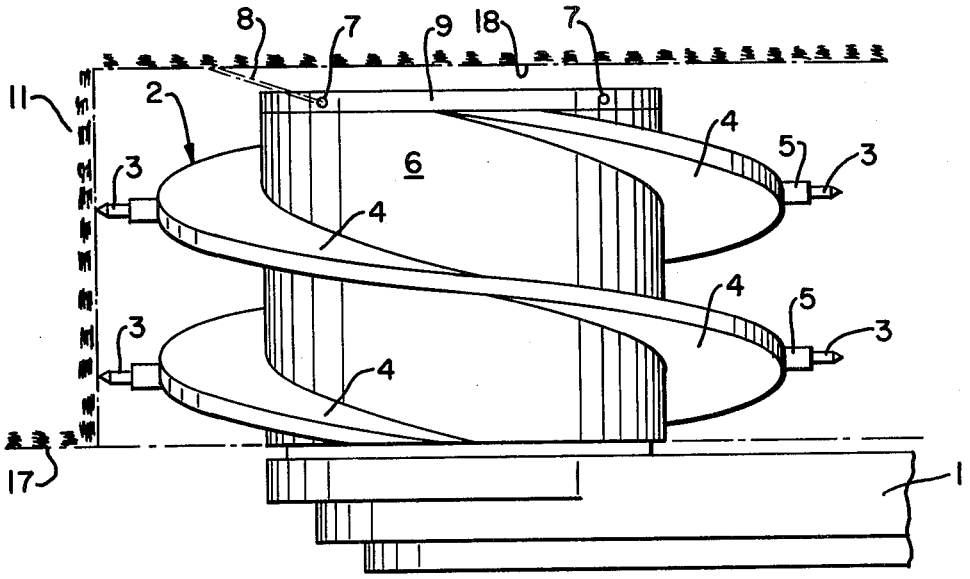
FIG. 1 is a top view of a drum support arm and the cutter drum of the invention carried thereby for a longwall mining machine.

In FIG. 1, only the cutter drum support arm 1 and the cutter drum 2 itself are shown. The cutter drum is cylindrical in configuration and has spiral flights 4 on its periphery which carry cutter bits 3 mounted in bit holders 5. In the operation of the device, the drum 2 will rotate and will advance to the left as viewed in FIG. 1, thereby loosening and disengaging material from a generally semi-cylindrical face area 11. As it does so, it produces a cut having a forward edge 17 and a rear edge 18.

The cutter bits 3 do not extend over the entire length of the cutter drum 2. In the area of the cutter drum housing 6 adjacent the rear edge 18 of the cut, the cutter bits are replaced by high-pressure nozzles 7 which are disposed in the peripheral region of the cutter drum housing 6 on which the spiral flights 4 are carried. Suitable valving means, not shown, is provided within the drum 2 such that only those nozzles 7 which face the face area 11 being mined will deliver fluid under pressure to the face area. These nozzles 7 discharge liquid streams 8 which assist in loosening and releasing material being mined immediately in front of the rear portion of the cutter drum 2.

It will be noted that in the embodiment shown in FIG. 1, the nozzles are at a relatively long distance away from the face area 11 to be worked in the direction of machine movement. However, if desired, the spirals 4 can be extended into the plane of the cutter drum end face and the nozzles can be arranged near the outside edges of the flights, directly adjacent the material to be mined, in order to improve the effectiveness of the nozzles.

Alternatively, the end plate 9 of the drum body can be a separate component in the form of a disc which is connected to a spindle or axle disposed inside the drum and disconnected from the drum such that it does not rotate therewith. A disc 9 of this typee will have nozzles 7 distributed over its periphery in two groups. Suitable valving, not shown, will be provided to connect only the nozzles 7 facing the face area 11 with high-pressure liquid. Thus, as the drum moves to the left as shown in FIG. 1, the nozzles 7 to the left of the axis of the drum will be pressurized; whereas when the drum moves to the right, the nozzles on the right side of the stationary plate 9 will be supplied with liquid under high pressure.

Figure 2:
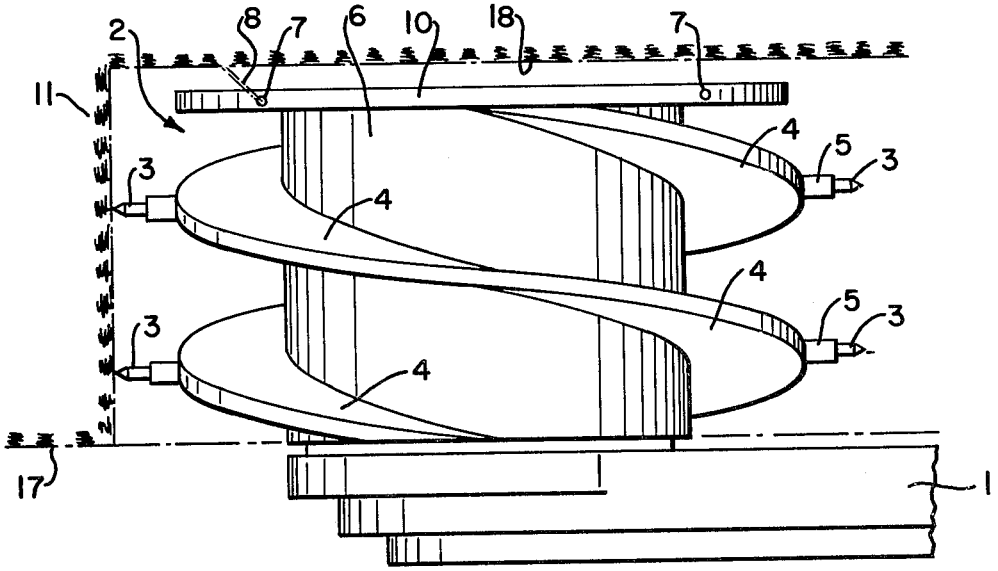
FIG. 2 is a top view similar to that of FIG. 1 but showing another embodiment of the invention which employs an end ring.

In the embodiment shown in FIG. 2, the cutter drum, on its end face adjacent the back edge 18 of the cut, is provided with an end ring 10 rigidly secured to the drum body such that it rotates with the same. The end ring 10, which is of the same diameter as the outside diameter of the spiral flights 4, has nozzles 7 disposed around its periphery together with suitable valving which supplies high-pressure fluid to only those nozzles which, as the drum rotates, are adjacent the face area 11.

In FIG. 3, another embodiment of the invention is shown which incorporates a cowl 13, similar to that shown in copending application Ser. No. 240,506, filed Mar. 4, 1981 and assigned to the Assignee of the present application. The cowl 13, which is mounted in an arm 14 pivotally mounted on the axle 12 of the drum 2, can pivot from the position shown in FIG. 3 to a diametrically-opposite position when the longitudinal direction of movement of the cutter drum is reversed. In all cases, the cowl 13 follows the forward advance of the cutter drum and assists in moving the mined material along the spiral flights 4 (FIG. 1) and onto a conveyor disposed beneath the arm 1. In the embodiment of FIG. 3, the arm 14 is integral with or secured to a generally semicircular plate 15 which, on its peripheral surface, carries nozzles, similar to nozzles 7 shown in FIGS. 1 and 2. These nozzles produce high-pressure liquid jets 8 projecting into the face area 11. As in the previous embodiments, the high-pressure jets 18 loosen and dislodge the material directly ahead of the semicircular plate 15. In FIG. 3, the cowl 13 and plate 15 are shown in their positions which they occupy when the drum 2 moves to the right. However, when the drum moves to the left, the arm 14 and plate 15 will be rotated about the spindle or axle 12 to assume diametrically-opposite positions. The plate 15, as will be understood, is located adjacent the back face or surface 18 of the cut as viewed in FIGS. 1 and 2.

The nozzles 7 in all embodiments of the invention can be disposed radially or tangentially with respect to the periphery of the drum. As shown, for instance, in FIG. 4, the nozzles 7 can be supplied individually or in pairs by way of a radial bore 16 extending from a central liquid supply line (not shown) located within the interior of the cutter drum 2. The nozzles 7 are inclined inwardly and outwardly with respect to the axis of the radial bore 16 in order to widen the area of the face 11 upon which the jets 8 impinge, thereby providing sufficient clearance for the drum to pass.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. A cutter drum for longwall mining machines and the like comprising a rotatable member having cutting bits disposed on its outer periphery and arranged to rotate about an axis extending parallel to a mine floor, said drum being movable along a longwall face to provide a cut extending back into the face as the drum rotates and advances, the end of the drum at the back of the cut being free of cutting bits, a non-rotatable, relatively thin-walled disc secured to the axis about which the drum rotates, and nozzles distributed over the periphery of said disc in two groups, one group being adapted to deliver high-pressure liquid in one direction of machine travel and the other group being adapted to deliver high-pressure liquid in the other direction of machine travel, said nozzles being carried on said disc at the end of the drum at the back of said cut for spraying high-pressure liquid radially outwardly from the axis of said drum onto the material being mined at the back of the cut to loosen and dislodge the same, said high-pressure liquid acting to loosen and dislodge material being mined without the assistance of cutting bits.

2. The cutter drum of claim 1 wherein at least one spiral flight is carried on said drum and said cutting bits are disposed on the outer periphery of said spiral flight at points removed from said end of the drum at the back of said cut.

3. A cutter drum for longwall mining machines and the like comprising a rotatable member having cutting bits disposed on its outer periphery and arranged to rotate about an axis extending parallel to a mine floor, a cowl mounted on an arm pivotal around the axis of said drum, a generally semicircular plate member carried by said arm on the side of said axis opposite the cowl, said drum being movable along a longwall face to produce a cut extending back into the face as the drum rotates and advances, the end of the drum at the back of the cut being free of cutting bits, and nozzles carried on said end of the drum at the back of said cut for spraying high-pressure liquid onto the material being mined at the back of the cut to loosen and dislodge the same, said nozzles being peripherally spaced on said semicircular plate member, said high-pressure liquid acting to loosen and dislodge material being mined without the assistance of cutting bits.

4. The cutter drum of claim 3 wherein at least one spiral flight is carried on said drum and said cutting bits are disposed on the outer periphery of said spiral flights at points removed from said end of the drum at the back of said cut.

* * * * *